US005813646A

United States Patent [19]

Bartholomae

[11] Patent Number: 5,813,646

[45] Date of Patent: Sep. 29, 1998

[54] DEVICE FOR MOUNTING A RECEPTACLE

[76] Inventor: Edward E. Bartholomae, 2711 Ripple Springs, Arlington, Tex. 76016

[21] Appl. No.: 946,051

[22] Filed: Oct. 7, 1997

Related U.S. Application Data

[63] Continuation of Ser. No. 541,452, Oct. 10, 1995, abandoned.

[51] Int. Cl.[6] ..... A47K 1/08

[52] U.S. Cl. ..... 248/311.2; 248/511; 248/230.7

[58] Field of Search ..... 248/511, 311.2, 248/289.11, 230.1, 230.7, 231.81, 218.4, 220.92, 223.41, 224.51

[56] References Cited

U.S. PATENT DOCUMENTS

| | | | |
|---|---|---|---|
| D. 236,175 | 5/1975 | Wintz | D6/93 |
| 3,151,910 | 10/1964 | Larson | 248/511 |
| 3,184,201 | 5/1965 | Smith | 248/311 |
| 3,370,820 | 2/1968 | Liss et al. | 248/230.7 X |
| 3,881,677 | 5/1975 | Ihlenfeld | 248/224.51 X |
| 4,697,780 | 10/1987 | Wenkman et al. | 248/558 |
| 4,821,988 | 4/1989 | Jimenez | 248/230.7 X |
| 4,878,642 | 11/1989 | Kirby, Jr. | 248/311.2 |
| 5,356,107 | 10/1994 | Sinohulz | 248/230.7 X |

FOREIGN PATENT DOCUMENTS

| | | | |
|---|---|---|---|
| 24486 | 11/1906 | United Kingdom | 248/289.11 |

*Primary Examiner*—Ramon O. Ramirez
*Assistant Examiner*—Willie Berry, Jr.
*Attorney, Agent, or Firm*—Geoffrey A. Mantooth

[57] ABSTRACT

A device is provided for mounting a receptacle which allows the receptacle to be swiveled out of the way when not in use. The device includes an arm, a provision for attaching the arm to a post or leg, and a provision for attaching a receptacle to the arm. In one embodiment of the invention, the arm has a hole through one end into which a bushing is mounted. The bushing is used to mount the arm to a boat seat by allowing the seat mounting pin to pass through the bushing. In another embodiment of the invention, a mechanism for temporarily attaching the receptacle to the arm is provided so that the receptacle can be removed from the arm and a variety of receptacles used on a single arm.

12 Claims, 11 Drawing Sheets

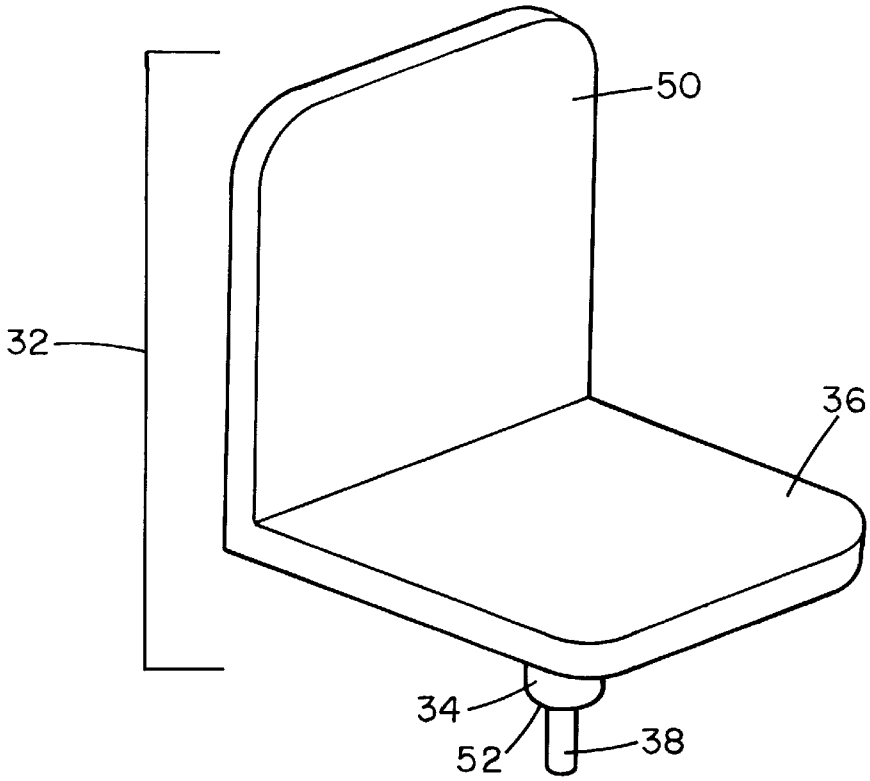
FIG. 4
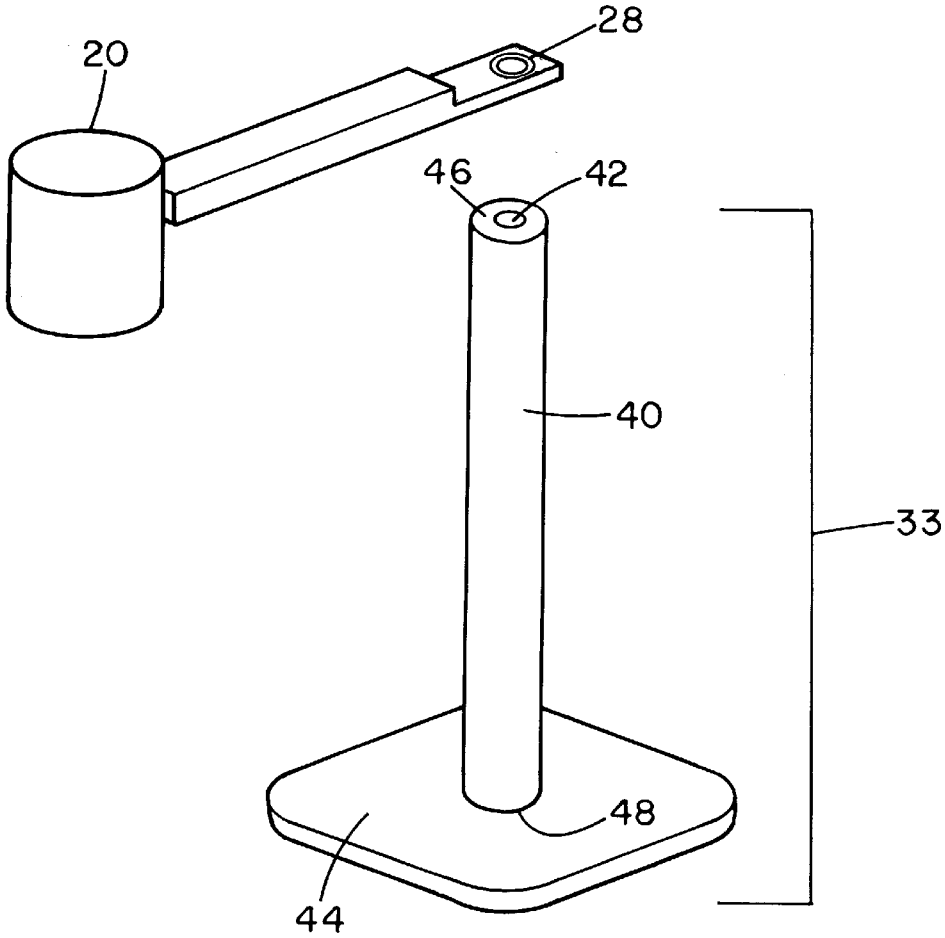

DEVICE FOR MOUNTING A RECEPTACLE

This is a continuation of application Ser. No. 08/541,452 filed Oct. 10, 1995, now abandoned.

TECHNICAL FIELD OF THE INVENTION

This invention generally relates to a device for mounting a receptacle and more particularly a device for mounting a receptacle which allows the receptacle to be swiveled out of the way when not in use.

BACKGROUND OF THE INVENTION

While engaging in many activities, such as boating or fishing from a boat, it is often desirable to have a beverage or other items within easy reach. Determining a convenient location for such items becomes more complicated after the boat has been anchored or when a trolling motor is in use to change direction. As the wind blows and other boats pass, the boat often drifts in the water, rotating about the location of the anchor. Normally, one fishes in a particular location with respect to the boat, such as a submerged fence line or area with submerged tree stumps or branches. As the boat rotates, the person fishing must also turn in order to remain facing the area being fished. These movements will very often cause the beverage or other items to move out of reach of the person fishing.

In addition, safety concerns also suggest that items which are needed while traveling from one area of a body of water to another, fishing, or engaging in other activities be nearby to minimize the amount of movement required by persons inside the boat.

Further, it is convenient in certain circumstances to have a receptacle for a beverage or other items which is within easy reach of the user but can be swiveled out of the way when not needed.

Beverage holders designed for use on boats are well known in the art. Such holders are designed to clip into a bracket permanently mounted to the interior of a boat. By mounting multiple brackets in various locations in the boat, the holder can be moved from one location to another. However, in most cases the brackets cannot be mounted in locations so that the beverage holder is within easy reach of the user at all times. Holders of this type also cannot be moved out of the way when not needed except by moving the holder to another bracket in a different location in the boat.

In the same way, other types of receptacles, such as boxes, hooks, and the like are needed while engaging in many activities to hold tackle, parts, bags, and so forth.

It also can be readily seen that the use of this type of device would be desirable while participating in many activities other than boating, such as hunting and in many work-related activities.

Therefore, a need exists for a device to mount a receptacle within easy reach of a user but that can also be swiveled out of the way when not in use.

OBJECTS OF THE INVENTION

One object of the invention is a device for mounting a receptacle.

Another object is a device for mounting a receptacle which allows the receptacle to be swiveled out of the way when not in use.

A further object of the invention is a device for mounting a receptacle to a seat.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the claims.

SUMMARY OF THE INVENTION

According to the present invention, the foregoing and other objects are attained by a device for mounting a receptacle. The device includes an arm, a provision for attaching the arm to a object such as a seat, and a provision for attaching a receptacle to the arm.

In accordance with another aspect of the present invention, the arm has a hole through one end into which a bushing is mounted. The bushing is used to mount the arm by allowing a pin to pass through the bushing. The arm has a provision on its end opposite the bushing for attaching a receptacle to the arm.

In accordance with yet another aspect of the present invention, a mechanism for temporarily attaching the receptacle to the arm is provided. In this way, the receptacle can be removed from the arm and a variety of receptacles used on a single arm.

A further aspect of the invention provides a device for mounting a receptacle which has a c-shaped spring attached to one end of the arm. The c-shaped spring allows the arm and a receptacle to be mounted by pushing the spring radially onto a post or leg. The spring elastically deforms to accommodate the post on its inside diameter.

Still a further aspect of the invention is a device for mounting a receptacle which has a c-shaped spring at one end of the arm and also has rollers mounted to the inside diameter of the c-shaped spring. The spring elastically deforms to accommodate a leg or post within its inside diameter against the rollers.

In accordance with yet another aspect of the invention, a device for mounting a receptacle is provided which has a hinged ring at one end of the arm and a latch to hold the ring in a closed position. While in the open position, the ring can be positioned so that a leg or post is accommodated along a portion of the inside diameter of the ring. The ring can then be closed and latched around the leg or post.

BRIEF DESCRIPTION OF THE DRAWINGS

For a more complete understanding of the present invention, and for further advantages thereof, reference is now made to the following Best Mode for Practicing the Invention taken in conjunction with the accompanying drawings, in which:

FIG. 4 is a pictorial view of a device of the present invention showing its use with a seat.

BEST MODE FOR PRACTICING THE INVENTION

Figure 1:
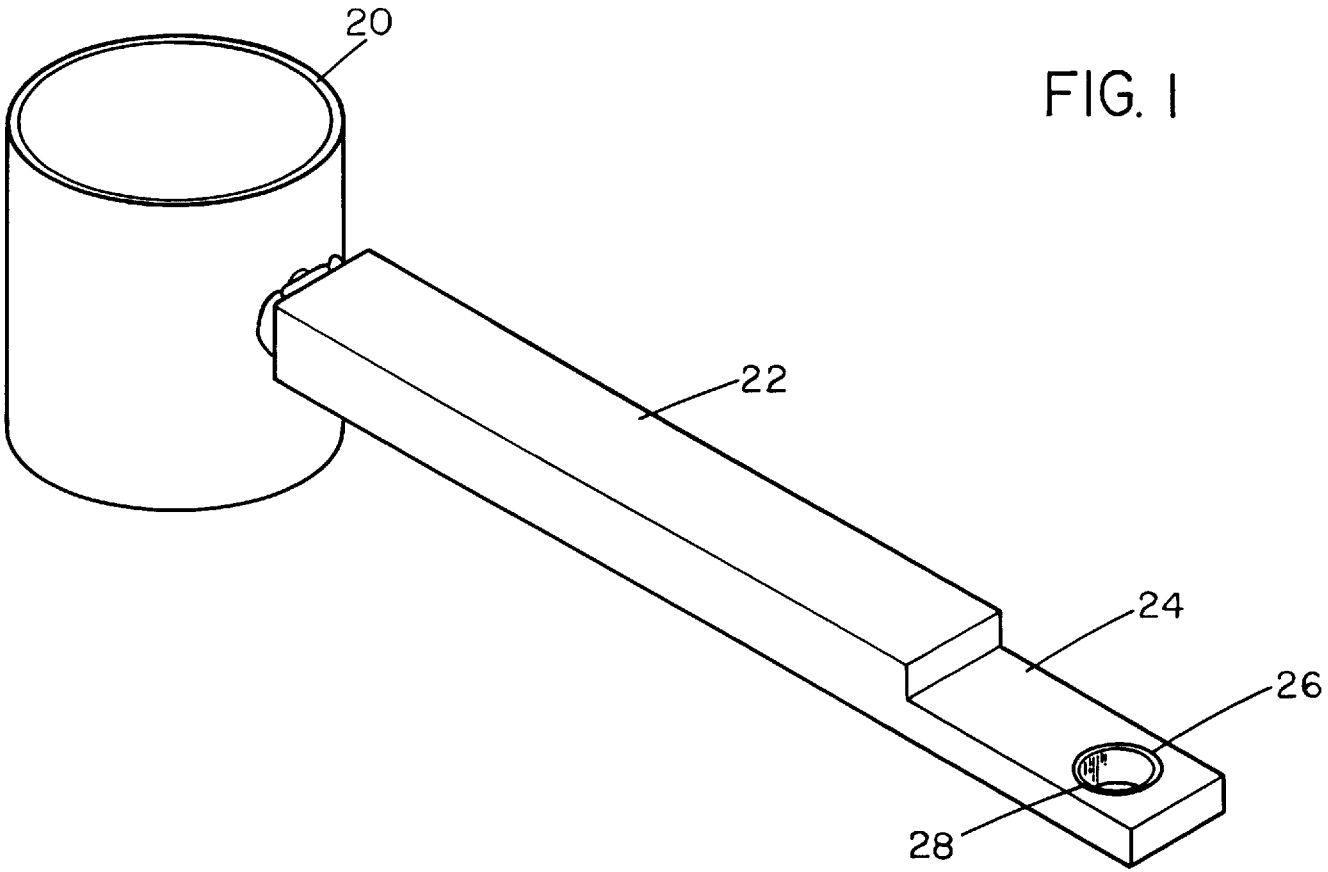
FIG. 1 is a pictorial view of a device of the present invention in which the means of attachment is a bushing.

With reference now to the accompanying drawings wherein like reference numerals designate similar parts throughout the several views, a device for mounting a receptacle is provided. In FIG. 1, one embodiment of the present invention is made of an arm 22 which, in this embodiment, has an area of reduced thickness 24 and is used to mount a beverage holder 20. The arm 22 can be made from a variety of materials such as, but not limited to, wood, aluminum, plastics or any other material which provides suitable strength to support the beverage holder 20. The arm 22 contains a hole 26 within this area of reduced thickness 24. A bushing 28 is affixed inside the hole 26. The bushing 28 can be made of, but not limited to, bronze, Delrin™, ultra high molecular weight polyethylene (UMPE) or any other material which provides suitable strength and lack of friction.

Figure 2:
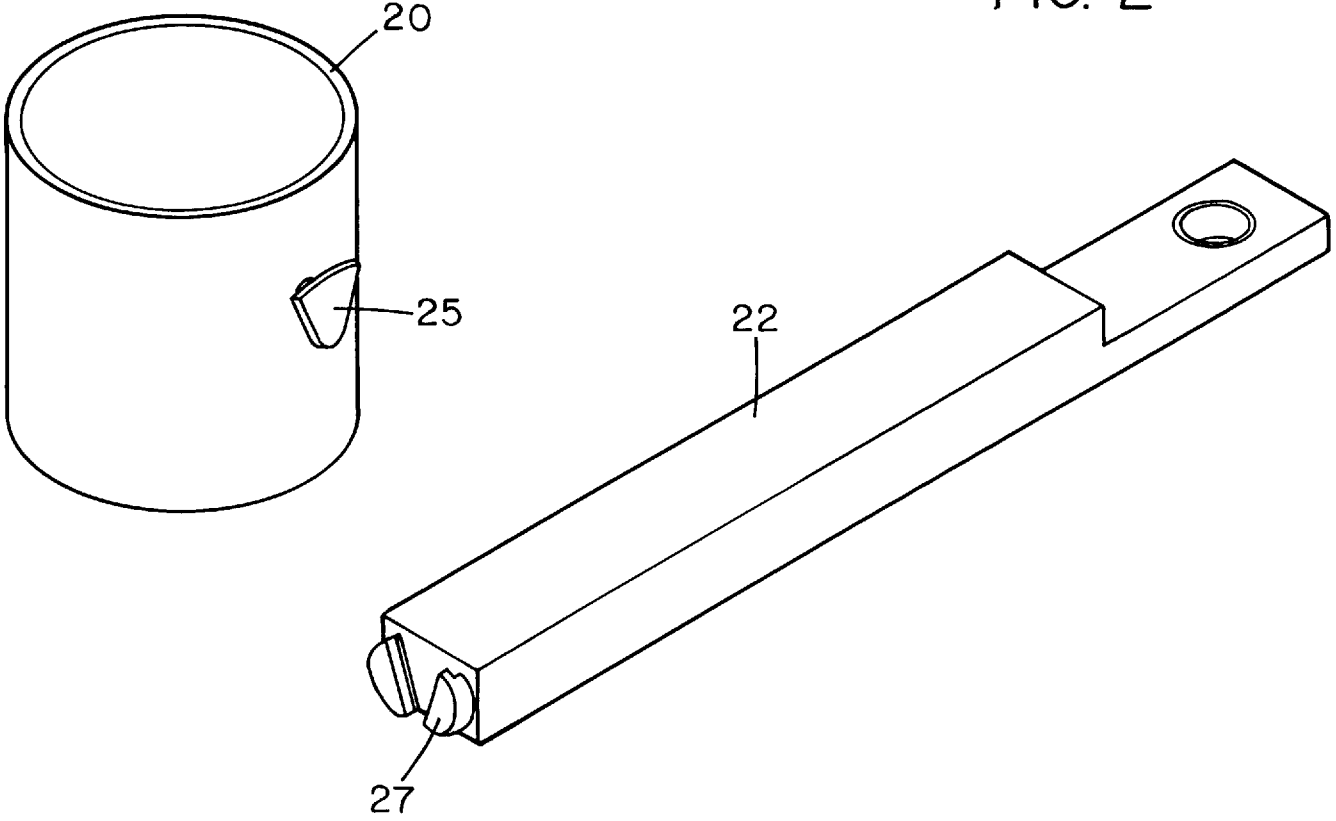
FIG. 2 is a pictorial view of a device of the present invention in which the receptacle and device are disassembled and rotated to show a temporary receptacle attachment device.

Referring now to FIG. 2, the beverage holder 20, and indeed any receptacle, can be attached to the arm 22 in a permanent fashion or be removable from the arm 20. In this embodiment of the present invention, the beverage holder 20 is attachable and removable from the arm 22 by using a slide 25 which slides into and mates with clip 27. As can be readily seen, many attachment devices could be used to either permanently or temporarily attach a device of the present invention to a receptacle. In addition, a device of the present invention and a receptacle could be fashioned from a single contiguous piece of material.

Figure 3:
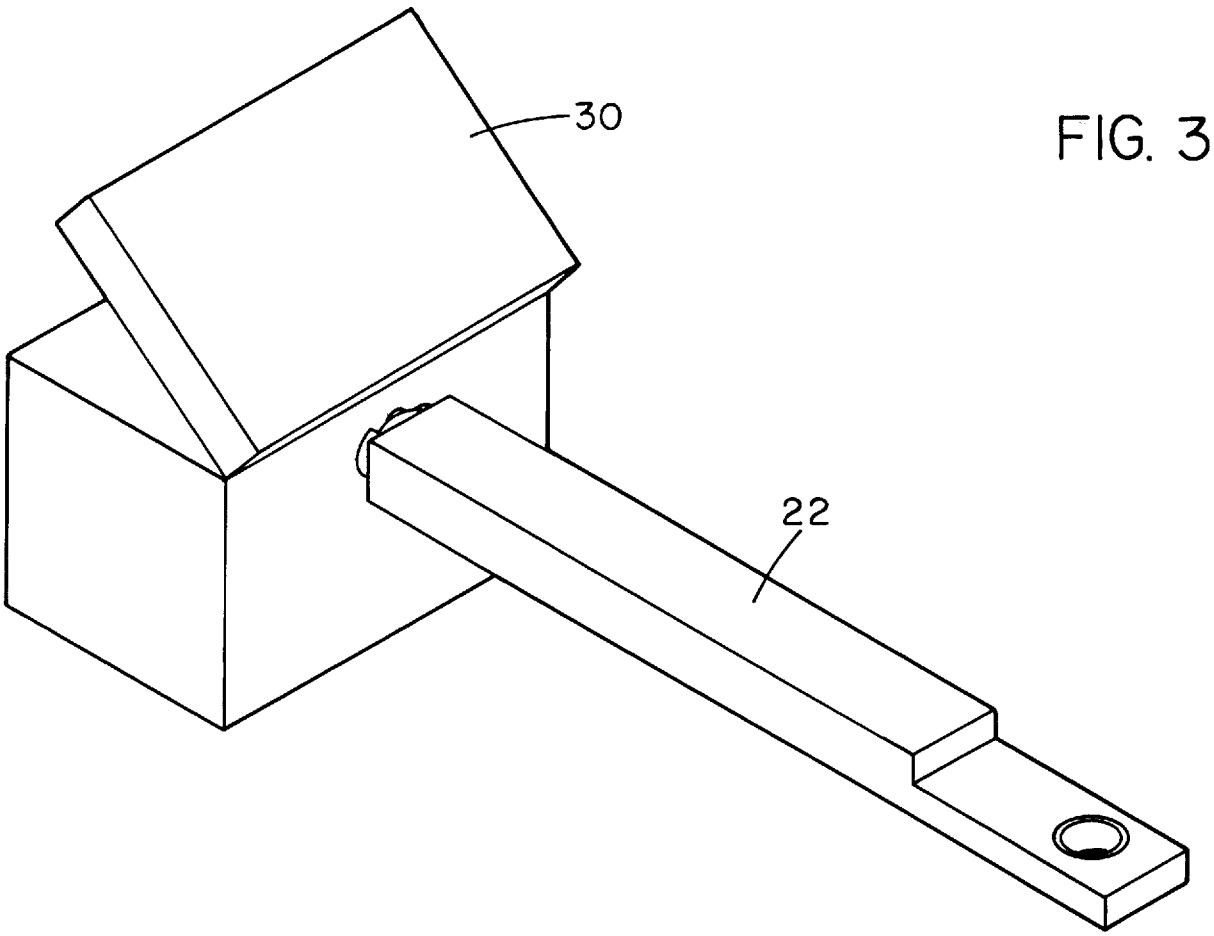
FIG. 3 is a pictorial view of a device of the present invention in which the receptacle is a box.

Referring now to FIG. 3, another embodiment of the present invention is provided for a box-type receptacle 30. In this embodiment as in the embodiment depicted in FIG. 2, the box-type receptacle 30 can be attached to the arm 22 in a permanent fashion or be removable from the arm 22. In addition, the box-type receptacle 30 and arm 22 could be fashioned from a single contiguous piece of material. It can be readily seen by comparing the elements in FIGS. 1, 2, and 3 that the present invention can be used to mount a variety of receptacle types.

Directing attention now to FIG. 4, a device for mounting a receptacle is shown along with beverage holder 20, a seat 32, and a seat base 33. In this application, a seat post 34 is mounted to the underside of the seat bottom 36. A mounting pin 38 is rigidly attached to the bottom portion 52 of the seat post 34 concentric with the longitudinal axis of the seat post 34. The seat base 33 also has a pedestal post 40 with a hole 42 in its upper end 46 concentric with the longitudinal axis of the pedestal post 40. The hole 42 has a diameter slightly larger than the diameter of the mounting pin 38. A mounting plate 44 is attached to the lower end 48 of the pedestal post 40 and is used to attached the seat base 33 to surface (not shown).

During normal usage of the boat seat 32 without a device of the present invention, the mounting pin 38 is placed into the hole 42 to assemble the complete seat assembly. In this configuration, the seat bottom 36 and seat back 50 can swivel about an axis defined by the centerline of the pedestal post 40, hole 42, mounting pin 38, and seat post 34.

When a device of the present invention is used with the seat 32, the mounting pin 38 is placed through the bushing 28 then placed into the hole 42 to assemble the seat 32 to seat base 33. In this configuration, the device of the present invention as well as the seat bottom 36 and seat back 50 can swivel about an axis defined by the centerline of the pedestal post 40, hole 42, mounting pin 38, and seat post 34. In this way the beverage holder 20 (or other receptacle as desired) can be placed within reach of the user irrespective of the orientation of the user to the surroundings and swiveled out of the way when not in use.

Figure 5:
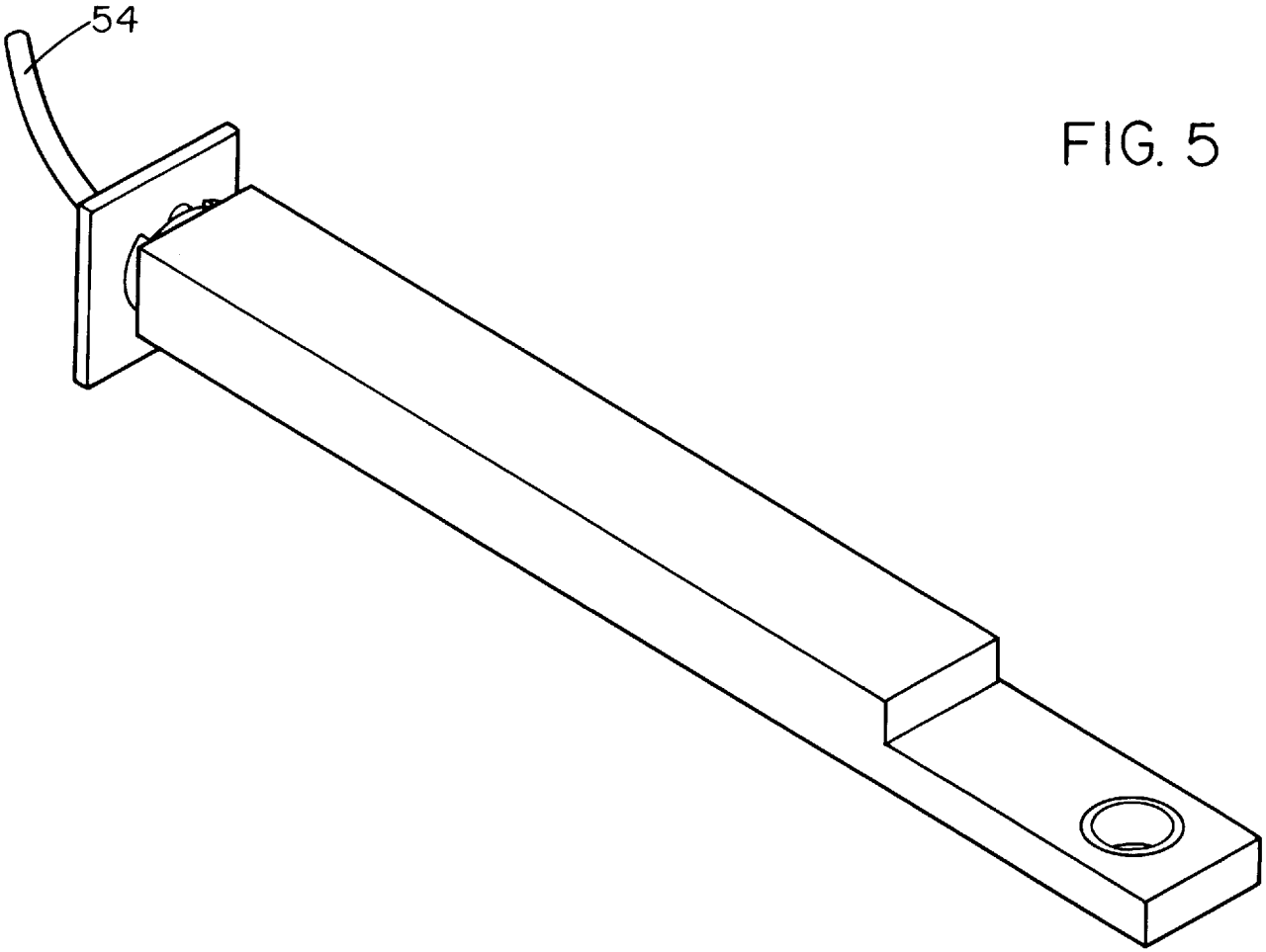
FIG. 5 is a pictorial view of a device of the present invention in which the receptacle is a hook.

As can be readily seen in FIG. 5, the receptacle to be mounted by the device of the present invention could be a hook 54 to hold a bag, sack, or the like.

Figure 6:
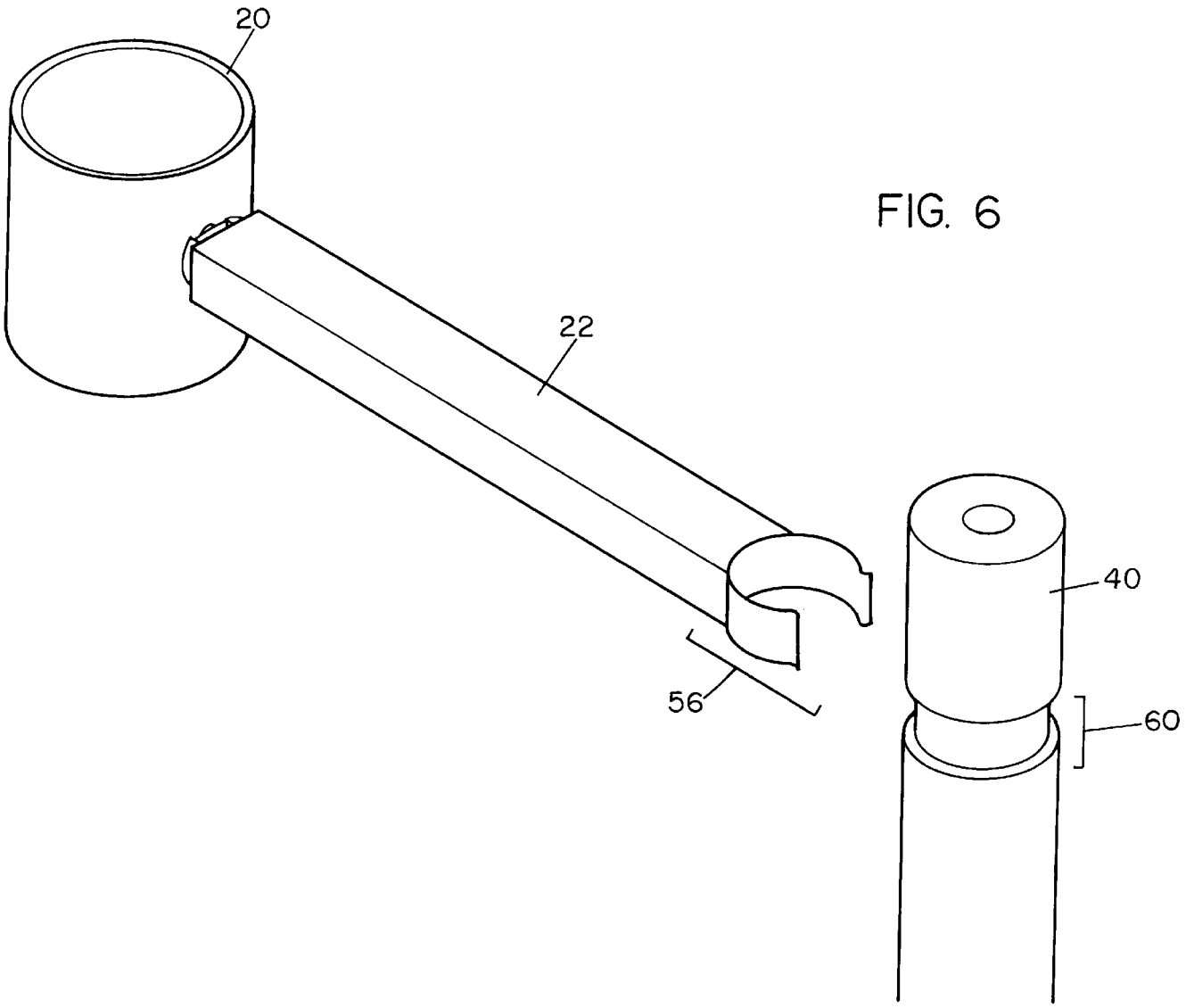
FIG. 6 is a pictorial view of a device of the present invention in which the means of attachment is a c-shaped spring and of a post with a reduced diameter section.

Referring now to FIG. 6, a device of the present invention is provided which employs a c-shaped spring 56. In one application, a pedestal post 40 has an area of reduced diameter 60. As the c-shaped spring 56 is pushed radially onto pedestal post 40, the c-shaped spring 56, made of a material with suitable elastic properties, elastically deforms to accommodate the outside diameter of the area of reduced diameter 60 of pedestal post 40 within the inside diameter of the c-shaped spring 56. Also, since the inside diameter of the c-shaped spring 56 is smaller than the diameter of the pedestal post 40 which is not reduced in diameter, the device of the present invention is prevented from moving freely along the longitudinal axis of the pedestal post.

Figure 7:
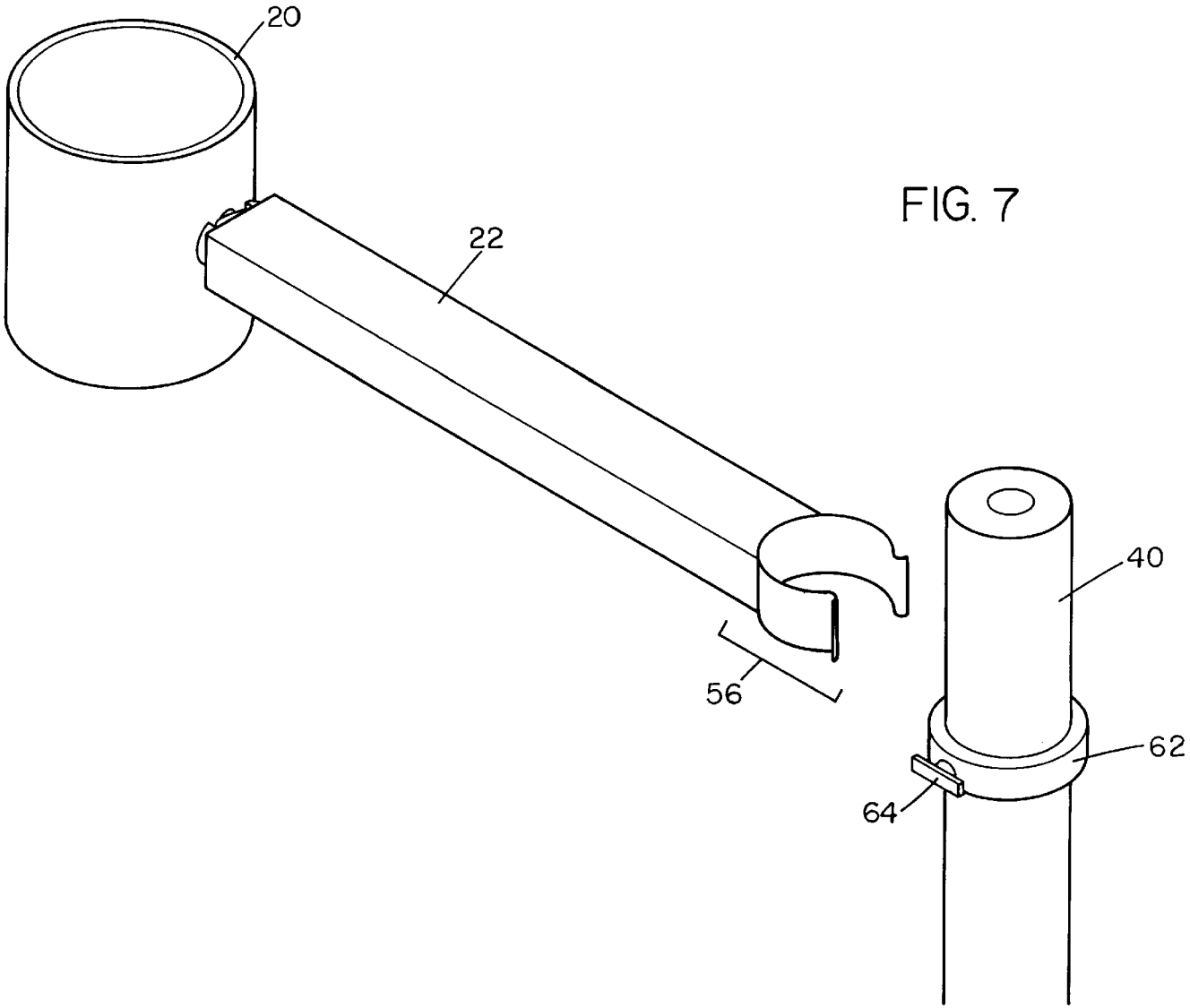
FIG. 7 is a pictorial view of a device of the present invention of FIG. 6 and of a post with a positionable collar.

Looking now at FIG. 7, the same c-shape spring embodiment of the present invention is shown along with a pedestal post 40 which has a constant diameter. A collar 62 with set screw 64 prevents the c-shape spring 56 from moving downward along the longitudinal axis of the pedestal post. This is accomplished by placing collar 62 around the outside diameter of pedestal post 40, positioning collar 62 to an appropriate location along the longitudinal axis of pedestal post 40, and advancing set screw 64 until in contact with the outside diameter of pedestal post 40.

Figure 8:
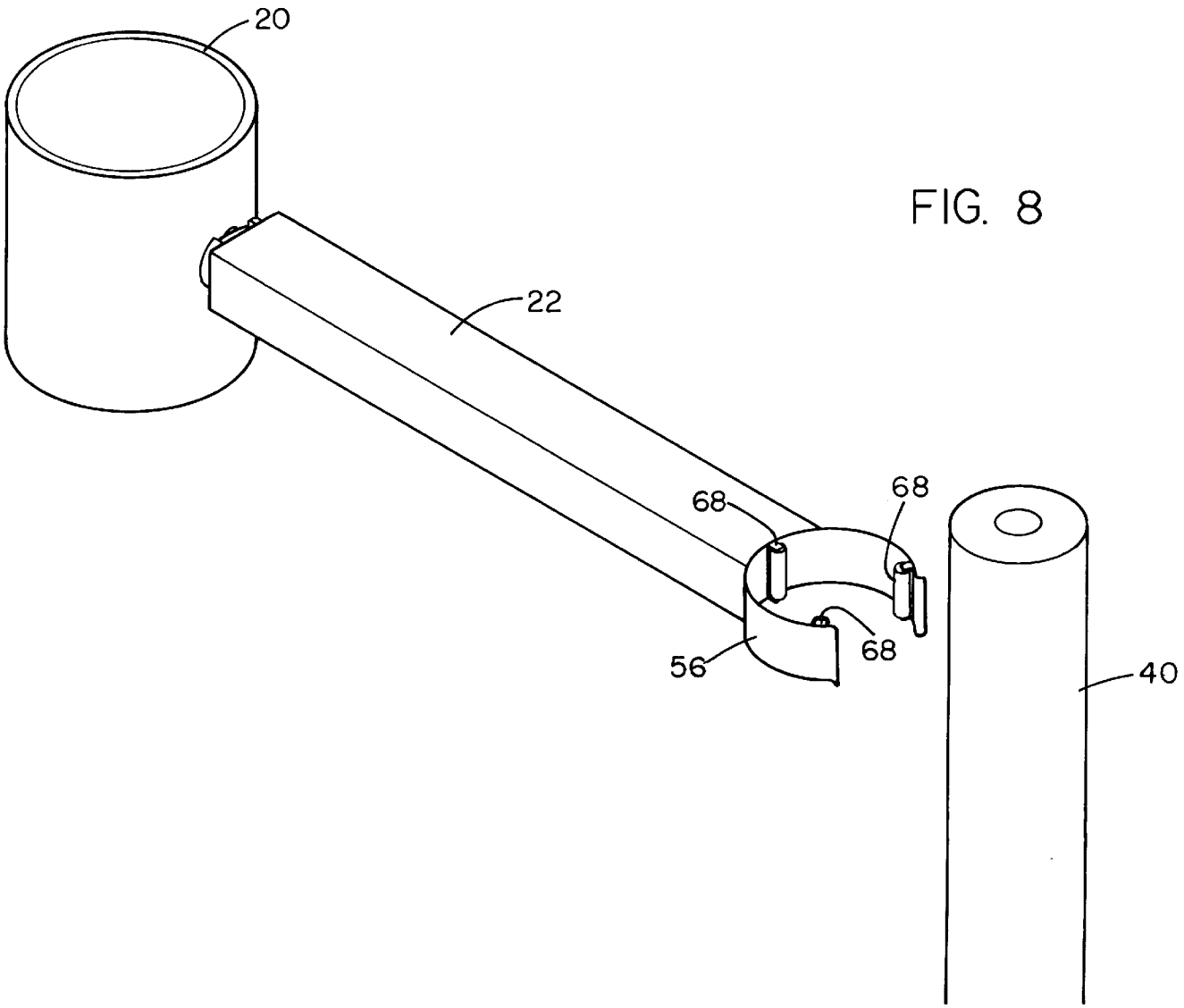
FIG. 8 is a pictorial view of a device of the present invention in which the means of attachment is a c-shaped spring with rollers mounted on the inside diameter of the c-shaped spring.
Figure 9:
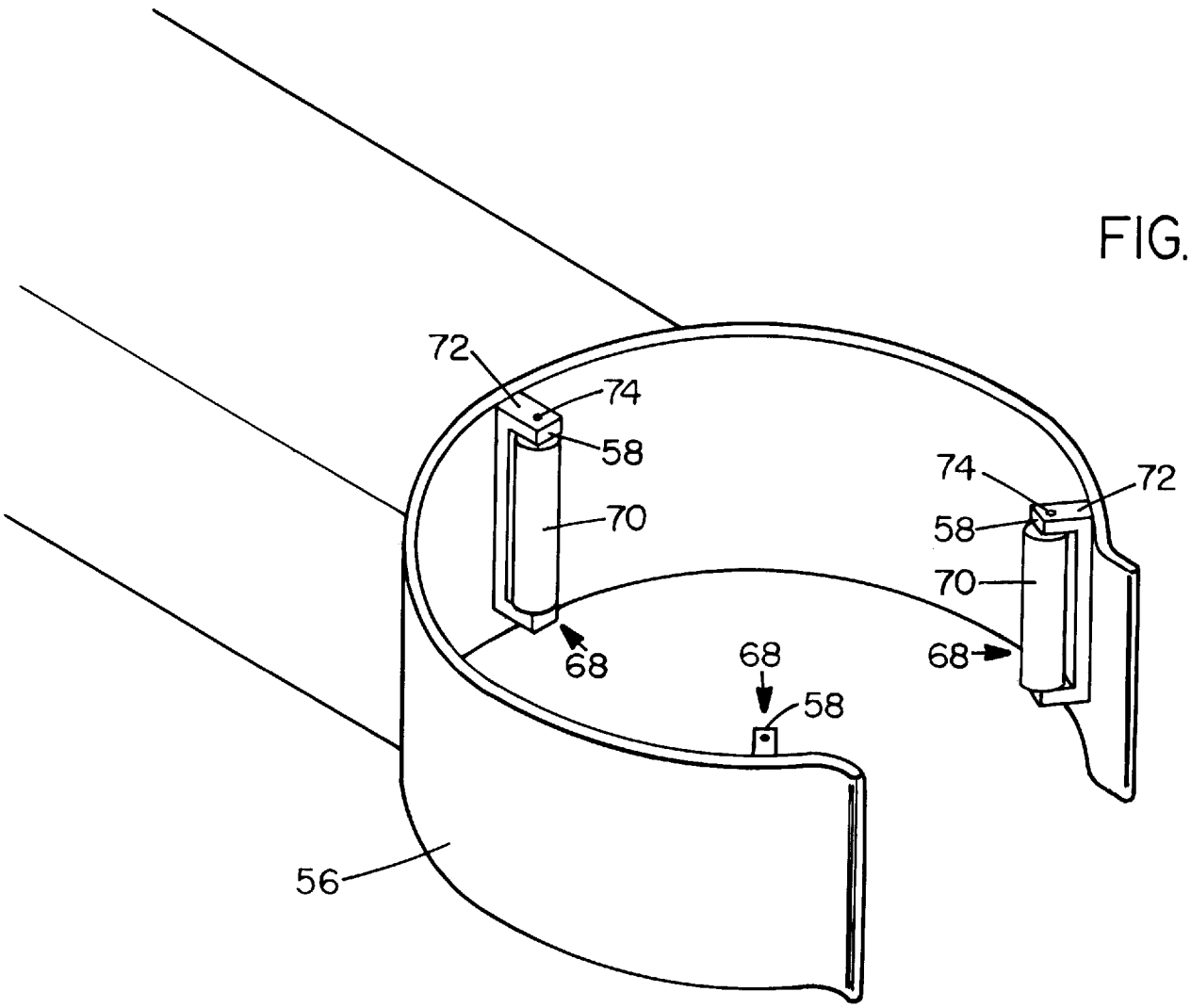
FIG. 9 is an enlarged pictorial view of a device of the present invention of FIG. 8.

Turning attention now to FIGS. 8 and 9, a device of the present invention is presented which builds on the c-shape spring embodiment of FIGS. 6 and 7. Roller assemblies 68 are mounted to the inside diameter of c-shape spring 56. Referring to FIG. 9, these roller assemblies 68 can be seen in greater detail. In this embodiment, each roller assembly 68 is made of a roller mount 72 which is attached to the inside diameter of c-shape spring 56. A shaft 74 passes through the center of roller 70 and is held in place between two roller mount ears 58. As the c-shaped spring 56 is pushed radially onto pedestal post 40, the c-shaped spring 56 elastically deforms and two of the roller assemblies 68 come into contact with the pedestal post 40. Upon further advancement of the c-shaped spring 56 onto the pedestal post 40, the first two rollers 70 roll around the circumference of the pedestal post 40 until the third roller 70 comes into contact with the pedestal post 40. The arm 22 and receptacle, in this case beverage holder 20, are then mounted to the pedestal post 40. In one embodiment, at least the outside surface of rollers 70 are made of a material which will not readily allow the device of the present invention to move along the longitudinal axis of the pedestal post 40. The rollers 70, however, will allow the device of the present invention to rotate or swing about the longitudinal axis of the pedestal post 40.

Figure 10:
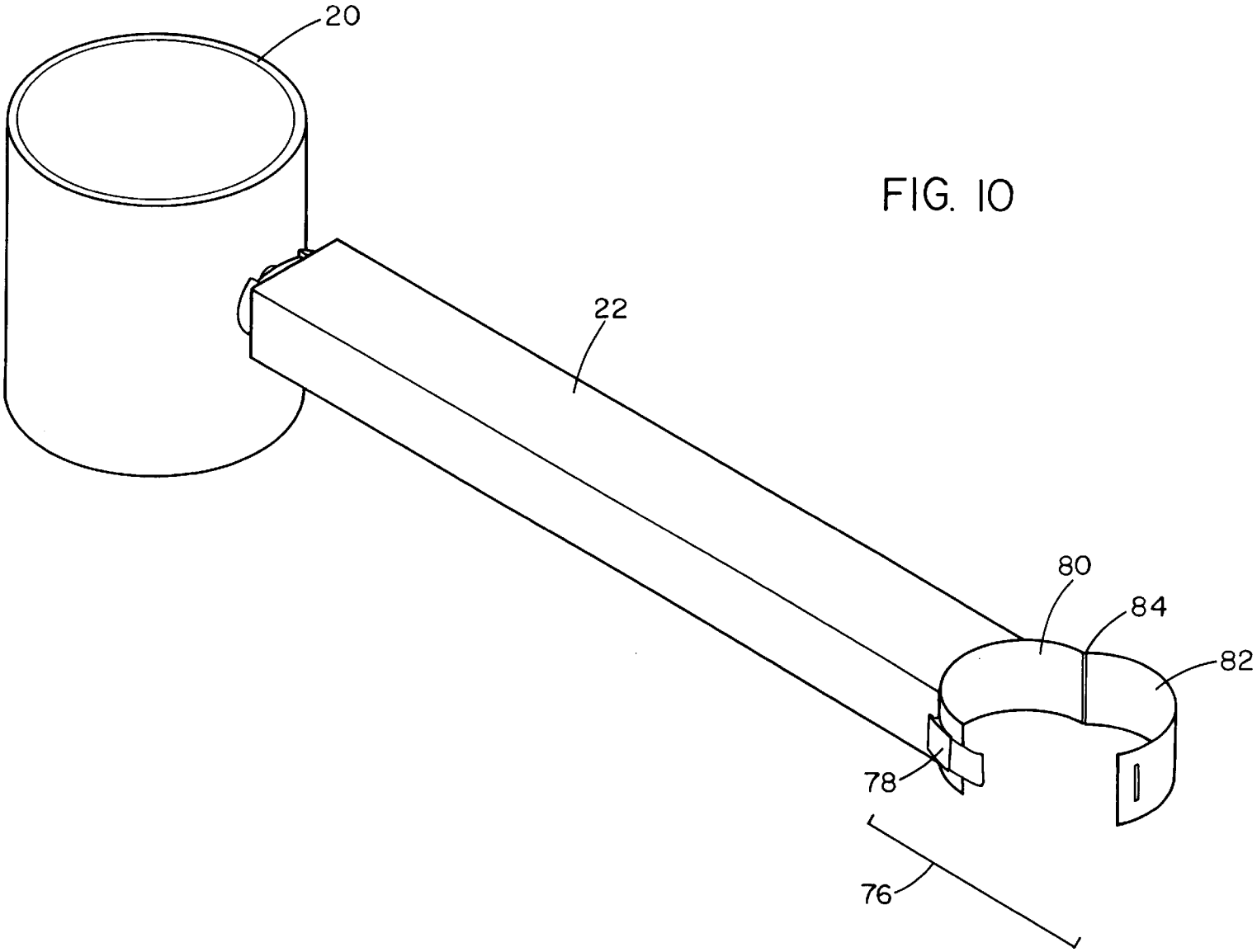
FIG. 10 is a pictorial view of a device of the present invention in which the means of attachment is a hinged split band with latch in the open position.
Figure 11:
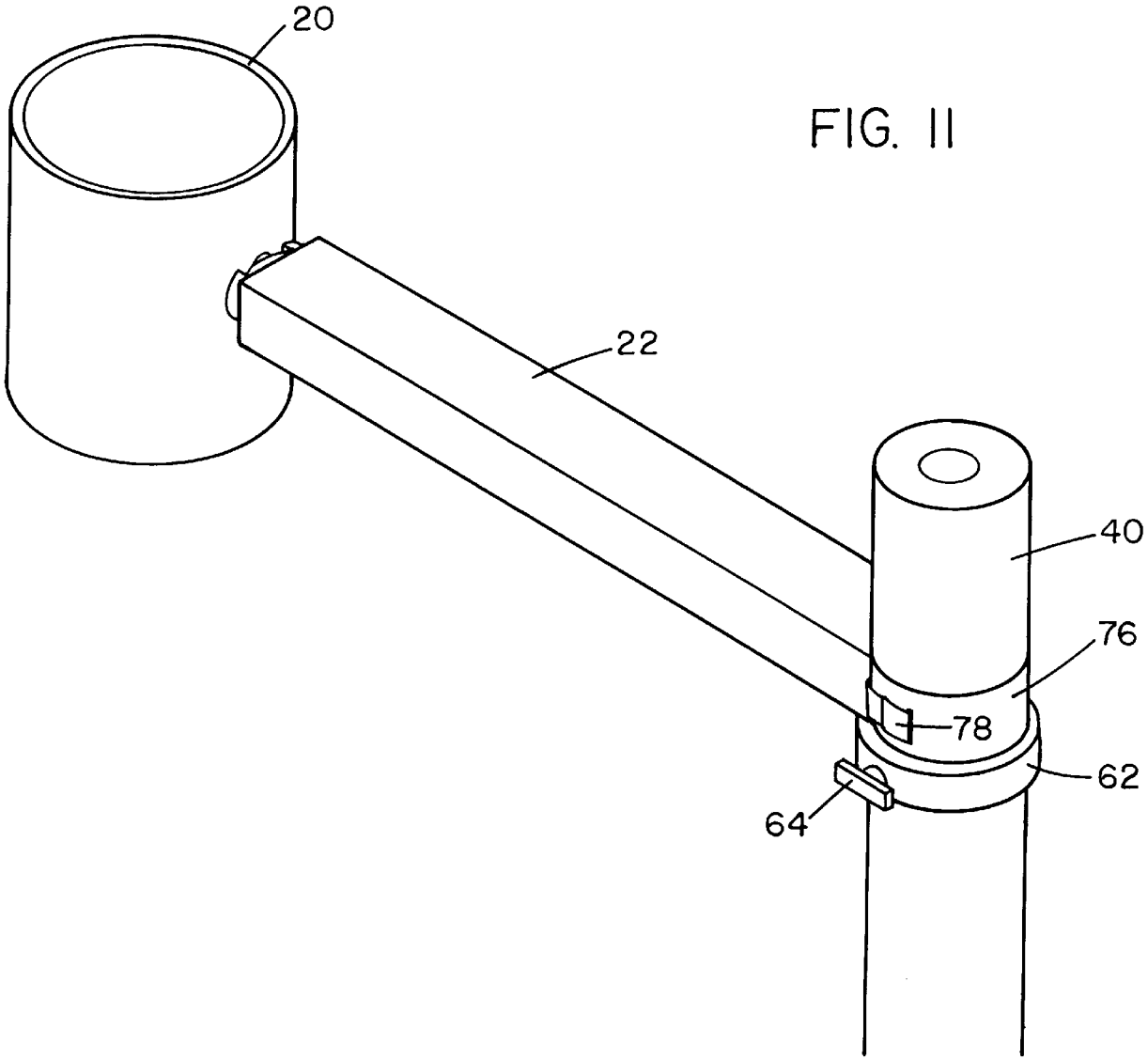
FIG. 11 is a pictorial view of a device of the present invention of FIG. 10 attached to a post.

Referring now to FIG. 10, an embodiment of the present invention is provided which employs a split band 76, hinge 84 and latch 78 to mount arm 22 and receptacle 20. In order to mount the receptacle, latch 78 is unlatched, thereby allowing movable portion 82 to rotate about the pivoting axis of hinge 84. As can be seen in FIG. 11, the outside diameter of pedestal post 40 is brought into contact with the inside diameter of fixed portion 80 (shown in FIG. 10) of split band 76. Movable portion 82 is rotated about the pivoting axis of hinge 84 (shown in FIG. 10) to close split band 76 around the outside diameter of pedestal post 40. Latch 78 is latched to hold movable portion 82 in a closed position or in contact with the outside diameter of pedestal post 40. A collar 62 and set screw 64 are used in one application to control the downward movement of the device of the present invention along the longitudinal axis of the pedestal post 40. This is accomplished, as described previously, by placing collar 62 around the outside diameter of pedestal post 40, positioning collar 62 to an appropriate location along the longitudinal axis of pedestal post 40, and advancing set screw 64 until in contact with the outside diameter of pedestal post 40.

Although several embodiments of the present invention have been illustrated in the accompanying drawings and described in the foregoing Best Mode for Practicing the Invention, it will be understood that the invention is not limited to the embodiments disclosed but is capable of numerous rearrangements, modifications, and substitutions of parts and elements without departing from the spirit and scope of the invention.

I claim:

1. An apparatus for supporting accessories, comprising:

a) a seat;

b) a seat base;

c) a seat mount comprising a first mounting member that is coupled to the seat and a second mounting member that is coupled to the seat base, the first and second mounting members being coupled to each other so as to support the seat upon the seat base, the first mounting member being rotatable with respect to the second mounting member;

d) an arm having a first end portion and a second end portion;

e) the arm first end portion having a receptacle mounted thereto;

f) the arm second end portion being coupled to the first mounting member so as to swivel with respect to the seat base, the arm second end portion being rotatably coupled to the seat mount, wherein the arm can rotate independently of the seat about a longitudinal axis of the seat mount.

2. The apparatus of claim 1 wherein:

a) the first mounting member comprises a pin and the second mounting member comprises an end, the end having a first opening therein, the first opening receiving the pin, the pin being oriented along a longitudinal axis of the seat mount;

b) the arm second end portion having a second opening, the arm second end portion bearing against the second mounting member end and the second opening of the arm receiving the pin, wherein the arm can swivel about the seat mount independently of the seat.

3. The apparatus of claim 1 wherein:

a) the seat mount comprises a shoulder;

b) the arm second end portion having an opening which receives a portion of the first mounting member, the arm second end portion bearing on the shoulder, the opening allowing the arm to swivel with respect to the first mounting member.

4. The apparatus of claim 3 further comprising a bushing located in the opening of the arm second end portion.

5. The apparatus of claim 1 wherein the arm second end portion has an opening therein, the opening receiving the first mounting member.

6. The apparatus of claim 1 wherein the receptacle is removably mounted to the arm first end portion.

7. The apparatus of claim 6 wherein the receptacle is mounted to the arm first end portion by way of a dovetail projection and slot arrangement, with the projection being located on one of the receptacle or the arm and the slot being located on the other of the receptacle or the arm.

8. The apparatus of claim 1, wherein:

a) the seat mount comprises a pedestal with the first mounting member being coupled to an underside of the seat;

b) the arm extending from the pedestal radially outward so that the receptacle is positioned out from the seat.

9. The apparatus of claim 1, wherein:

a) the first mounting member comprises a pin and the second mounting member comprises an end, the end having a first opening therein, the first opening receiving the pin, the pin being oriented along a longitudinal axis of the seat mount;

b) the arm second end portion having a second opening, the arm second end portion bearing against the second mounting member end and the second opening of the arm receiving the pin, wherein the arm can swivel about the seat mount independently of the seat;

c) a bushing is located in the second opening of the arm second end portion;

d) the receptacle is mounted to the arm first end portion by way of a dovetail projection and slot arrangement, with the projection being located on one of the receptacle or the arm and the slot being located on the other receptacle or the arm;

e) the seat mount comprises a pedestal with the first mounting member being coupled to an underside of the seat;

f) the arm extending from the pedestal radially outward so that the receptacle is positioned out from the seat.

10. The apparatus of claim 1 wherein the receptacle is a in holder.

11. The apparatus of claim 1 wherein the receptacle is a box.

12. An apparatus for supporting accessories, comprising:

a) a seat;

b) a seat base;

c) a seat mount comprising a first mounting member that is coupled to the seat and a second mounting member that is coupled to the seat base, the first and second mounting members being coupled to each other so as to support the seat upon the seat base, the first mounting member being rotatable with respect to the second mounting member;

d) an arm having a first end portion and a second end portion;

e) the arm first end portion having a receptacle mounted thereto;

f) the arm second end portion being coupled to the first mounting member so as to swivel with respect to the seat base;

g) the arm second end portion has an opening therein, the opening receiving the first mounting member;

h) the opening in the arm second end portion is formed by two projections separated from each other by a gap.

* * * * *